United States Patent [19]

Nishida et al.

[11] 3,931,537

[45] Jan. 6, 1976

[54] MATRIX ELECTRODE GAS DISCHARGE DISPLAY PANEL HAVING TERMINALS SPACED WIDER THAN ELECTRODES

[75] Inventors: Kazunori Nishida; Isao Inomata, both of Tokyo, Japan

[73] Assignee: Nippon Electric Company Limited, Tokyo, Japan

[22] Filed: Feb. 4, 1974

[21] Appl. No.: 439,252

[30] Foreign Application Priority Data

Feb. 27, 1973 Japan ..... 48-24809[U]
Feb. 27, 1973 Japan ..... 48-24810[U]

[52] U.S. Cl. ..... 313/188; 313/201; 313/217; 313/220

[51] Int. Cl.[2] ..... H01J 61/067; H01J 61/30

[58] Field of Search ..... 313/188, 201, 220, 217; 340/173 PL, 324 M

[56] References Cited

UNITED STATES PATENTS

| | | | |
|---|---|---|---|
| 3,631,287 | 12/1971 | Hoehn | 313/188 |
| 3,684,918 | 8/1972 | Schmersal | 315/169 R |
| 3,735,182 | 5/1973 | Dalton et al. | 313/188 |
| 3,753,038 | 8/1973 | Liddle | 340/324 M X |

*Primary Examiner*—Palmer C. Demeo
*Attorney, Agent, or Firm*—John M. Calimafde

[57] ABSTRACT

A gas discharge display panel having row and column electrodes for displaying a plurality of patterns arranged in rows and columns comprises a pair of dielectric plates on which the row and column electrodes are respectively formed. The column electrodes are divided into groups assigned to the patterns in the respective columns. Terminal areas connected to the column electrodes of every other groups are disposed along different edge portions of the plate disposed parallel to the rows, whereby the terminal areas are spaced wider than the electrodes.

2 Claims, 4 Drawing Figures

MATRIX ELECTRODE GAS DISCHARGE DISPLAY PANEL HAVING TERMINALS SPACED WIDER THAN ELECTRODES

BACKGROUND OF THE INVENTION

This invention relates to a gas discharge display panel having matrix electrodes for displaying a plurality of patterns, such as numerals, letters, and/or symbols, arranged along at least one row and to a dielectric plate for use in manufacturing a gas discharge display panel on which one set of the matrix electrodes is formed.

For a gas discharge display panel having matrix electrodes, such as an external electrode gas discharge display usually referred to as a plasma display panel, use is made of a pair of plates, each made of an electrically insulating material. The plates are formed of glass or other insulating material, and have parallel electrodes formed thereon for use as the matrix row or column electrodes. Terminal areas are also formed on each of the plates and connected to the electrodes formed thereon. Since the electrodes are closely spaced, the terminal areas are also crowded and of a narrow width as shown in FIG. 1 of U.S. Pat. No. Des. 222,543 issued Nov. 2, 1971. This makes it difficult to connect the terminal areas to an external circuit, such as a driving circuit for the panel, with sufficient mechanical strength. In an attempt to overcome this difficulty i.e., the fragile connection between the panel and the external circuit, every other electrode is connected to terminal areas disposed along one edge portion of the plate, and the remaining electrodes are connected to terminal areas disposed along the opposite edge portion of the plate. This reduces the congestion at the terminal areas. The difficulty of effecting connections is not overcome, however, because there are no criteria for identifying the terminal areas connected to a particular electrode. This is not only true on making initial connections between the terminal areas and an external circuit, but also in locating the terminal corresponding to any electrode which fails to contributing to proper production of a corresponding elemental area of a display for trouble diagnosis and/or repair.

SUMMARY OF THE INVENTION

It is therefore an object of the present invention to provide a matrix electrode gas discharge display panel, wherein terminal areas connected to the electrodes on the panel are readily connected to an external circuit.

It is another object of this invention to provide a display panel of the type described, which may be reliably connected to an external circuit.

It is still another object of this invention to provide a display panel of the type described, wherein the terminal area connected to any specific one of the electrodes may be readily identified.

A matrix electrode gas discharge display panel for displaying a plurality of patterns arranged in rows and columns comprises a first and a second plate of an electrically insulating material. The first plate has a plurality of row electrodes formed thereon runing parallel to the rows and terminal areas connected on the plate to the respective row electrodes. Similarly, the second plate has a plurality of column electrodes formed thereon running parallel to the matrix columns and terminal areas connected on the second plate to the respective column electrodes. In accordance with the instant invention, the row electrodes are divided into a first set of groups. The terminal areas connected to row electrodes of each group are spaced apart from the terminal areas connected to the row electrodes of the other groups. Similarly, the column electrodes are divided into second set of groups. The terminal areas connected to the column electrodes of each of the second set of groups are spaced apart from the terminal areas connected to the column electrodes of the other groups. The display panel may be an external electrode gas discharge display panel having a central dielectric plate or one not having such a central plate. Preferably, the first set of groups are assigned to the patterns arranged along the respective rows while the second set of groups are assigned to the patterns arranged along the respective columns.

Figure 1:
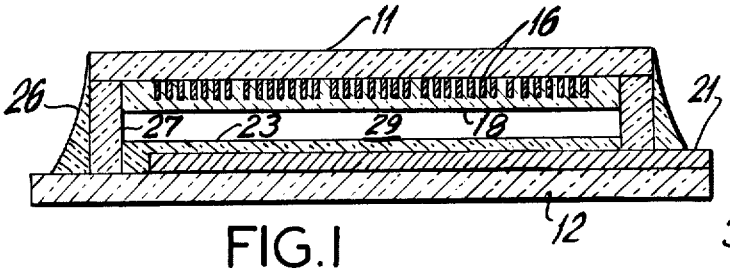
FIG. 1 schematically shows in sectional view a matrix electrode gas discharge display panel to which the instant invention is applicable, the thickness of the dielectric plates and the elements disposed thereon being exaggerated.

DESCRIPTION OF THE PREFERRED EMBODIMENTS:

Referring to FIGS. 1 through 4, an external matrix electrode gas discharge display panel for displaying a plurality of patterns arranged in rows and columns comprises a pair of first and second plates 11 and 12, herein called dielectric plates, formed of an electrically insulating material. At least one of the plates 11 and 12 should be sufficiently transparent to permit viewing the display therethrough. The first plate 11 has a plurality of column electrodes 16 formed thereon running parallel to the display columns, terminal areas 17 disposed on the plate 11 and connected to the respective column electrodes 16, and a layer 18 of a dielectric material covering the column electrodes 16. The second plate 12 has a plurality of row electrodes 21 formed thereon running parallel to the display rows, terminal areas 22 thereon connected to the respective row electrodes 21, and a layer 23 of a dielectric material covering the row electrodes 21.

The plates 11 and 12 having the above-described elements disposed thereon are sealed together by a mass 26 of a sealing agent, such as glass frit, with a spacer 27 being disposed therebetween. The elements formed on the first plate 11 should face the elements formed on the second plate 12 across an intermediate space. The space is evacuated and then filled with neon or a like ionizable gas to provide a gas discharge space 29.

In operation, a high-frequency voltage is applied between selected row and column electrodes to produce a gas discharge at each of the cross points of the selected electrodes. The dots of the gas discharge thus produced are viewed as a display of the desired pattern or patterns. It is therefore necessary to render the pitch (inter-electrode spacing) between the parallel electrodes 16 or 21 as small as possible to increase the resolution of the display panel. Accordingly, the terminal areas 17 or 22 are also crowded resulting in various difficulties discussed herein above.

Figure 2:
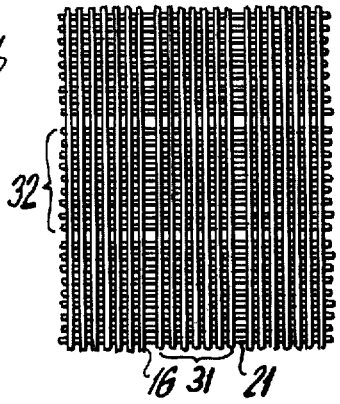
FIG. 2 is a schematic front view of a portion of the matrix electrodes for an embodiment of the present invention.
Figure 3:
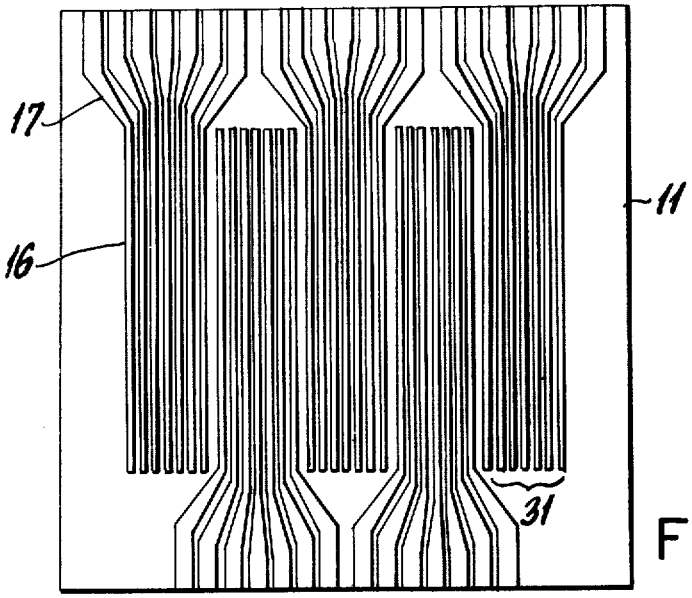
FIG. 3 schematically shows one of the dielectric plates having electrodes and terminal areas formed thereon in accordance with the principles of the present invention.
Figure 4:
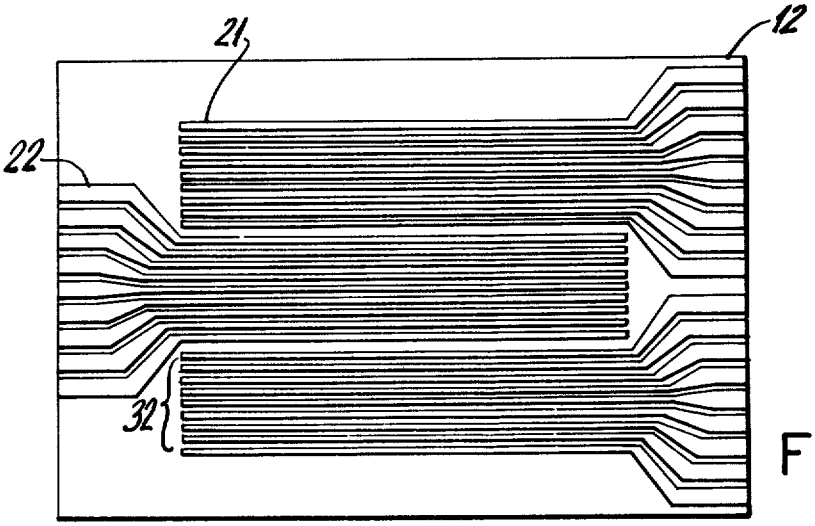
FIG. 4 similarly depicts the other of the dielectric plates and the corresponding elements formed thereon in accordance with this invention.

Referring more specifically to FIGS. 2 through 4, the column and row electrodes 16 and 21 are divided into groups 31 and 32 assigned to the respective patterns in accordance with this invention. In the specific embodiment illustrated, each column electrode group 31 consists of seven column electrodes 16 while each row electrode group 32 consists of nine row electrodes 21. This grouping of the electrodes 16 and 21 enables the terminal areas 17 and 22 for the electrodes 16 and 21 of each group 31 or 32 to be spaced apart from the terminal areas 17 or 22 for the other corresponding groups 31 or 32. This similarly enables each terminal area 17 or 22 to be wider than the corresponding electrodes 16 or 21. In addition, such an organization facilitates identification of a terminal area 17 or 22 connected to a particular one of the electrodes 16 or 21. Preferably, the distance between the groups 31 or 32 is made wider than the pitch between the electrodes 16 or 21.

Further, the terminal areas 17 for alternate column electrode groups 31 are arranged along one of the edge portions of the first plate 11 parallel to the rows, while the terminal areas 17 for the remaining groups 31 are disposed along the other of such edge portions. Similarly, the terminal areas 22 for every other row electrode group 32 are aligned on one of the edge portions of the second plate 12 parallel to the matrix columns, while the remaining terminal areas 22 are arranged along the other edge portion.

It will readily be understood that this invention is equally applicable to a matrix electrode gas discharge display panel for displaying a plurality of patterns arranged along only one of the rows and columns, and to one having matrix electrodes spatially intersecting at angles other than right angles. It will also be apparent that the grouping of the electrodes 16 and 21 need not necessarily correspond to with the patterns to be displayed.

What is claimed is:

1. A matrix electrode gas discharge display panel for displaying a plurality of patterns arranged in rows and columns, wherein the improvement comprises:

a first plate of an electrically insulating material having a plurality of first electrodes formed thereon in a direction parallel to said rows, and first terminal areas on said plate connected to said first electrodes, contiguous ones of said first electrodes and said first terminal areas being divided into plural first groups, the terminal areas connected to the first electrodes of each of said groups being spaced apart from the terminal areas connected to the first electrodes of the others of said groups, and a second plate of an electrically insulating material having a plurality of second electrodes formed thereon in a direction parallel to said columns, and second terminal areas on said second plate connected to said second electrodes, contiguous ones of said second electrodes and said second terminal areas being divided into plural second groups, the terminal areas connected to the second electrodes of each of said second groups being spaced apart from the terminal areas connected to the second electrodes of the others of said second groups, wherein said first and second electrodes spatially intersect at plural gas filled cells, at least one of said electrodes being transparent, wherein:

said first terminal areas connected to said first electrodes are disposed along both edge portions of said first plate disposed in a direction parallel to said columns, the terminal areas disposed along each of said edge portions being connected to the first electrodes of alternate ones of said first groups, and the second terminal areas connected to said second electrodes are disposed along both edge portions of said second plate disposed in a direction parallel to said rows, the terminal areas disposed along each of said row direction edge portions being connected to the second electrodes of alternate ones of said second groups.

2. In a matrix electrode gas discharge display panel for displaying a plurality of patterns arranged in a row, comprising a first plate of an electrically insulating material, a plurality of first electrodes formed on said first plate parallel to said row, a second plate of an electrically insulating material, a plurality of parallel second electrodes formed in groups on said second plate spatially transverse to said first electrodes and with a predetermined pitch, means for hermetically sealing said first and second plates to provide a gas discharge space between said first and second electrodes with an ionizable gas sealed in said space, first terminal areas formed on said first plate along an edge portion thereof and connected to said first electrodes, groups of second terminal areas formed on said second plate along both edge portions thereof and connected to said second electrodes, and means for supplying a voltage between selected ones of said first and second terminal areas to produce gas discharges in said space in accordance with said patterns, at least one of said first and second plates being sufficiently transparent to allow said gas discharges to be viewed therethrough, the improvement wherein the second electrodes of one of said electrode groups are spaced on said second plate from the electrodes of adjacent electrode groups by a distance wider than said pitch and are not interposed between the electrodes of other electrode groups, and said second terminal area groups are connected to the second electrodes of alternate ones of said electrode groups and made wider than said electrode groups, each of said second terminal area groups being spaced apart from other terminal groups, each of said electrode groups being associated with a respective one of said patterns.

* * * * *